US009241854B2

(12) United States Patent
Gentile et al.

(10) Patent No.: US 9,241,854 B2
(45) Date of Patent: Jan. 26, 2016

(54) SEAT SUPPORT

(71) Applicants: Amy Gentile, Georgetown, MA (US); Michael Gentile, Georgetown, MA (US)

(72) Inventors: Amy Gentile, Georgetown, MA (US); Michael Gentile, Georgetown, MA (US)

( * ) Notice: Subject to any disclaimer, the term of this patent is extended or adjusted under 35 U.S.C. 154(b) by 16 days.

(21) Appl. No.: 14/011,801

(22) Filed: Aug. 28, 2013

(65) Prior Publication Data

US 2015/0061342 A1 Mar. 5, 2015

(51) Int. Cl.
*A47C 7/54* (2006.01)
*A61G 5/14* (2006.01)

(52) U.S. Cl.
CPC ..... *A61G 5/14* (2013.01)

(58) Field of Classification Search
CPC ..... A47C 1/16; A47C 4/02; A47C 7/546; B60N 2/4673
USPC ..... 297/252, 352, 440.24, 411.23, 411.26
See application file for complete search history.

(56) References Cited

U.S. PATENT DOCUMENTS

| | | | | |
|---|---|---|---|---|
| 2,545,840 | A * | 3/1951 | Browne | 297/252 |
| 2,914,115 | A * | 11/1959 | Cameron | 297/252 |
| 2,968,338 | A * | 1/1961 | Reese | 297/134 |
| 3,354,893 | A * | 11/1967 | Schmerl | 135/67 |
| 3,405,411 | A | 10/1968 | Brown et al. | |
| 3,639,929 | A * | 2/1972 | Ichise | 5/648 |
| 3,739,793 | A * | 6/1973 | Wilson | 5/503.1 |
| 4,922,560 | A * | 5/1990 | Skibinski | 5/81.1 HS |
| 5,397,169 | A * | 3/1995 | Willans | 297/411.23 |
| 5,414,871 | A | 5/1995 | Stevens | |
| 5,449,013 | A * | 9/1995 | Landers | 135/67 |
| 5,466,044 | A * | 11/1995 | Barley et al. | 297/252 |
| 5,498,054 | A * | 3/1996 | Tomlinson | 297/16.2 |
| 5,528,777 | A | 6/1996 | Arft | |
| 5,904,168 | A * | 5/1999 | Alulyan | 135/65 |
| 5,983,911 | A * | 11/1999 | Steele | 135/66 |
| 6,050,644 | A * | 4/2000 | Neal | 297/411.24 |
| 6,244,285 | B1 * | 6/2001 | Gamache | 135/67 |
| 6,332,232 | B1 * | 12/2001 | Neal | 5/662 |
| 6,338,493 | B1 * | 1/2002 | Wohlgemuth et al. | 280/30 |
| 6,349,423 | B1 | 2/2002 | Kelleher | |
| 6,352,306 | B1 * | 3/2002 | Dreiling | 297/252 |
| 6,715,161 | B1 | 4/2004 | Depoe, Jr. | |
| 6,857,138 | B2 | 2/2005 | Moser et al. | |
| 6,860,281 | B1 * | 3/2005 | Clift | 135/67 |
| 7,240,377 | B2 | 7/2007 | Vanden Heuvel | |
| 7,862,122 | B1 * | 1/2011 | Shammas | 297/411.23 |
| 8,075,059 | B2 * | 12/2011 | Kim | 297/378.12 |
| 8,402,572 | B2 | 3/2013 | Herasimtschuk | |
| 2003/0062757 | A1 * | 4/2003 | Calvery | 297/440.24 |

FOREIGN PATENT DOCUMENTS

| | | |
|---|---|---|
| WO | 9856281 | 12/1998 |
| WO | 2006094341 | 9/2006 |
| WO | 2012088599 | 7/2012 |

* cited by examiner

*Primary Examiner* — David E Allred
*Assistant Examiner* — Alexander Harrison
(74) *Attorney, Agent, or Firm* — Lambert & Associates; Gary E. Lambert; David J. Connaughton, Jr.

(57) ABSTRACT

A seat support device is provided. The seat support is configured to receive a seat cushion and provide support to the cushion as well as providing two support handles above the cushion. The combination of these elements allows an elderly, disabled, or otherwise weakened person to easily rise from a seated to standing position.

13 Claims, 3 Drawing Sheets

SEAT SUPPORT

BACKGROUND OF THE INVENTION

1. Field of the Invention

The present invention relates generally to seat support devices. More particularly, the present invention relates to a device that provides bi-lateral arm support as well as a firm seat support to people sitting on a chair, couch, or other seating apparatus.

2. Description of Related Art

Frequently, elderly people and people with low core or leg strength, face a challenge of getting up out of a seated position in a couch or chair. Indeed, many therapists spend a great deal of time trying to teach and help these people so that they can get out of their seated position comfortably and/or without injuring themselves. Many couches have only one arm support per seat and in some cases no arm supports. This makes it difficult for many to get up because they have nothing to brace themselves on. Further, many couches and chairs are low and soft. This further adds to the difficulty of rising from the seated position because they must rise further from seated to standing, and with less support from the soft seat.

Because of these issues, in the past, a number of inconvenient solutions have been used. One method of aiding in getting up from a seated position is for the person to place one hand on an arm rest and the other on the soft cushion. This method may work, but not all people in a weakened state have the strength for this method, and it can contribute to injury because of the need to use one arm instead of both. Another option is to have a family member or aid to pull the person up. This is inconvenient and these aids are not always around to help. Yet another option is a spring loaded seat or a seat lift. These may be helpful, but also can be dangerous and inconvenient if used improperly. Some solutions involve raising the couch seat such as risers or added pillows. This, as with other solutions, may help, but in many situations is uncomfortable and inconvenient. Still another option to aid in the weak or elderly is a stand frame that may extend partially under the couch. This helps greatly in getting up because it provides something to grab onto, however it can be extremely dangerous as a tripping hazard because it may get caught under one's feet. Further, the stand frame does not provide any seat support, so seat softness continues to be a challenge.

Therefore, what is needed is a device that may provide bi-lateral arm support and also make the seat reasonably firm.

SUMMARY OF THE INVENTION

The subject matter of this application may involve, in some cases, interrelated products, alternative solutions to a particular problem, and/or a plurality of different uses of a single system or article.

In one aspect, a seat support is provided. The seat support comprises a substantially rigid base sheet with two arm supports attached to opposite sides of the base sheet. The arm supports extend vertically away from the base sheet. Each arm support defines part of a cushion receiving region sized to receive a seat cushion. A bottom of the cushion receiving region is defined by the substantially rigid base sheet. Further, each arm support forms a support handle for a user to grasp when rising from a seated to standing position.

In another aspect, a seat support is provided. The seat support comprises a base sheet and two arm supports attached to opposite sides of the base sheet. Each arm support defining part of a cushion receiving region and having a support handle. A seat cushion is positioned within the cushion receiving region of each arm support and above a top surface of the base sheet.

In yet another aspect, a seat is provided. The seat comprises a seating area having a back and a bottom, a cushion positioned in the bottom. A seat support is positioned on the seat about the cushion. The seat support comprises a substantially rigid base sheet with two arm supports attached to opposite sides of the base sheet. Each arm support defining part of a cushion receiving region and a support handle. The seat support is positioned about the cushion by the cushion being received within the cushion receiving region with the base sheet being beneath the cushion.

DETAILED DESCRIPTION

Figure 1:
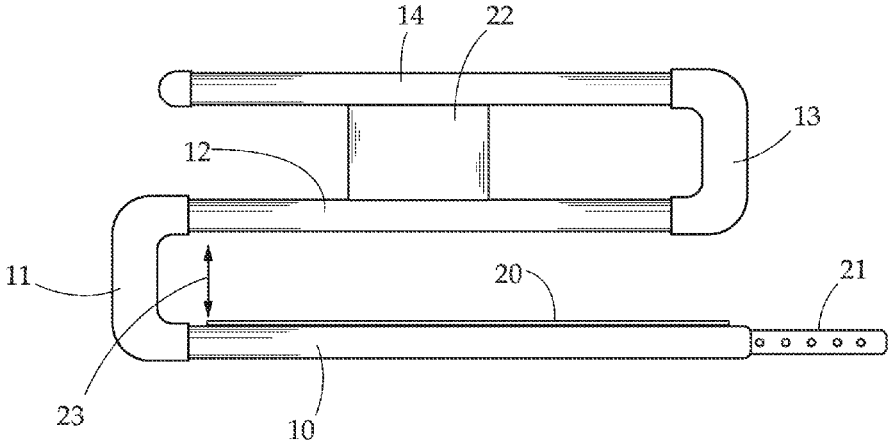
FIG. 1 provides a side view of an embodiment of an arm support of the present invention.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns two arm supports connected by a base sheet, with each of the two arm supports being sized and configured to receive a seat cushion, with the base sheet being positionable under the cushion. As such, the device may receive the cushion, and the cushion-device combination may be placed in the seat. The device thus provides support to the cushion as well as support handles to aid an elderly or weakened person in rising from the seated position.

The device contemplated herein may be formed in any manner capable such that the arm supports and base sheet may receive the couch cushion with the base sheet underneath the cushion and at least a portion of the arm supports on top of the cushion.

The arm supports contemplated herein may be formed of any material capable of receiving and holding the couch cushion that is strong enough to approximately retain its shape under the weight of a user while rising from a seated position. Examples of materials of which the arm supports may be made include, but are not limited to plastics, wood, composite materials, metals, and the like. In some embodiments, the arm supports may be made of a unitary construction, while in other embodiments, different materials pieces and shapes may be used.

The base sheet may be of any material capable of joining the first arm support to the second arm support. In some embodiments, the sheet may be a rigid sheet that provides a substantially rigid support of a cushion placed on top of it. The term substantially rigid is intended to mean something that is inflexible or only slightly flexible under the weight of an average person. In other embodiments, the sheet may be flexible, or partially flexible. Examples of materials of which the base sheet may be made include, but are not limited to: fabrics, plastic sheets, wood, metal sheets, composite materials, and the like.

In one embodiment, the sheet may be a solid and continuous rigid material such as plywood, hard plastic, or metal. In another embodiment, the sheet may be a grid such as a rigid grid of hard plastic, metal, or wood. In still another embodiment, the sheet may be formed as a plurality of strips extending between the two arm supports. In yet another embodiment, the rigid grid may have hinges or flexible connections between grid elements such that the grid may be collapsible, allowing the two arm supports to move towards each other in a collapsed position and extend away from each other in an extended position.

In one embodiment, the arm supports may be 'S' shaped. This S-shape may have curved edges, or sharply angled edges, or anything in between. A lower portion of the S shape being the cushion receiving region is sized to receive a seat cushion. Reception of the cushion may be by, for example, slidably receiving the cushion. In this embodiment, an upper portion, namely a top bar of the 'S' shape may be used as a support handle. The support handle can be grasped by a user for aiding in rising from the seated position. In some embodiments, the support handle may be reinforced by attachment to a central bar/shaft of the 'S' shape by, for example, a material connection between the top two horizontal portions of the 'S' shape. The material connection may be, among other things, a bar, plate, crossing support struts, or the like.

In one embodiment, the portion of arm supports forming the cushion receiving region may be formed of a thick material such as a tubing, bar, or the like. In this embodiment, the thickness of the material may serve to elevate the seat cushion by the thickness of the material. In one embodiment, the thickness may be between one inch and three inches. An advantage to an elevated seat is that a user has a shorter distance to travel to rise from a seated to standing position.

It should be understood that the arm supports may be in any shape capable of receiving a seat cushion that may also provide support handles. For example, the arm supports are not limited to an 'S' shape, and may be E-shaped, C-shaped, C-shaped with an extending arm support (shaped as a T, or any other extended arm support), or the like.

The two arm supports may be attached to the base sheet in any manner capable of supporting the seat cushion and allowing the arm supports to at least partially hold the weight of a person. In one embodiment, the arm supports may have a rigid connection to the base sheet such as a screw, nail, weld, glue, integral formation, or the like. In another embodiment, the arm supports may be rotatably attached to the base sheet by a hinge or the like. In a specific embodiment, the arm supports may be rotatable inwardly towards the base sheet, such that they may be folded down to a flat or nearly flat position. In still a further embodiment, the arm supports may be shaped such that they may fold inward without contacting each other, in that the arm supports may be slightly offset allowing both to fold inward to the base sheet.

In some embodiments, various elements of the arm supports may be adjustable to allow the arm supports to fit on various sized seating devices. For example, a length of the arm supports may be adjusted to fit longer cushions. Similarly, a height of the cushion receiving region of the arm supports may be adjustable to allow for thick or thin cushions. In some embodiments, the arm supports may also be adjustable in height and length depending on needs such as seating position, height, and the like.

Turning now to FIG. 1, a side view of an embodiment of an arm support of the present invention is provided. In this embodiment, the arm support is shown as generally S shaped, and formed of a plurality of different pieces (as opposed to a unitary arm support of other embodiments). A bottom shaft 10 connects to a first U-connector 11. A middle shaft 12 connects to the first U-connector 11 and the second U-connector 13. A top shaft 14 connects to the second U-connector. The middle shaft 12 and top shaft 14 are connected by support 22. The top portion of the 'S' shape, shown here as the top shaft 14 serves as the support handle for a user and therefore must be capable of supporting a weight from a person leaning on it while rising from a seated position. The support 22 aids in adding rigidity for the top shaft 14 support handle. Depending on material selection, the support 22 may not be required.

The embodiment of the arm support of FIG. 1 may be adjustable in both length and height. Telescoping shaft 21 is extendable into and out of bottom shaft 10 allowing the arm support to accommodate different sized cushions in the cushion receiving region 23. Similarly, U-shaped connector 11 may be extended in length to increase the height of cushion receiving region 23.

Figure 2:
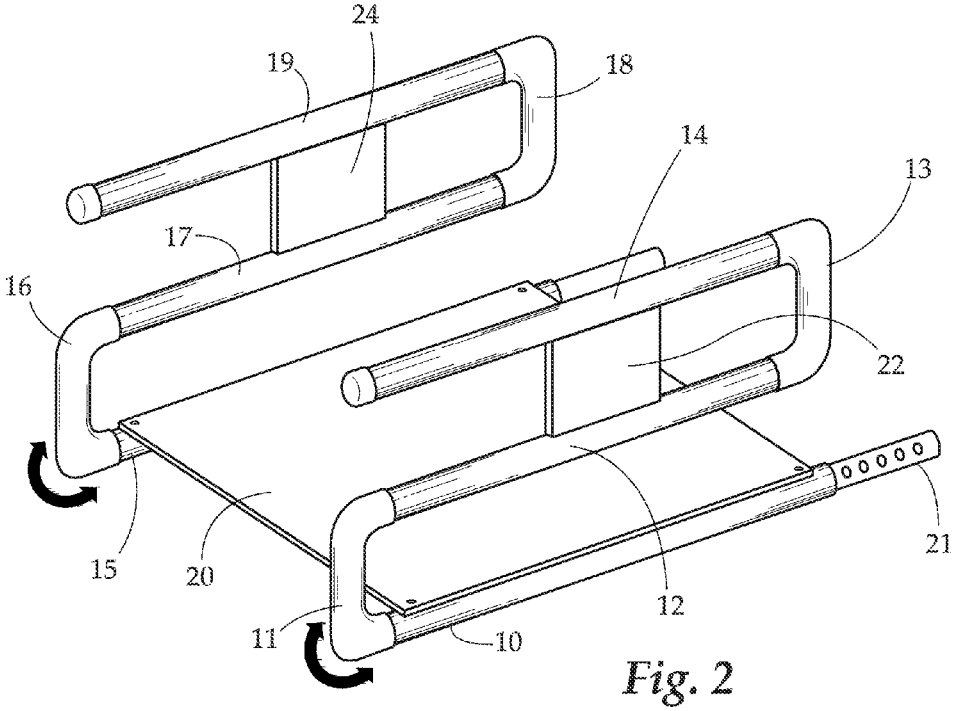
FIG. 2 provides a perspective view of an embodiment of the present invention.

FIG. 2 provides a perspective view of another embodiment of the seat support device. In this embodiment, the base sheet 20 as well as both arm supports can be seen. In this embodiment, both arm supports are substantially the same, each having a bottom shaft 10, 15 attached to a first U-shaped connector 11, 16. The bottom shafts 10, 15 are extendable in length by telescoping shafts 21, 22. A middle shaft 12, 17 is attached to the first U-shaped connector 11, 16, and the second U-shaped connector 13, 18. A top shaft 14, 19 extends from the second U-shaped connector 13, 18 and serves as the support handle. A support 22, 24 connects the top shafts 14, 19 and the middle shafts 12, 17. The bottom shafts 10, 15 are connected to the base sheet 20 at opposite ends of the base sheet 20. The base sheet 20, bottom shafts 10, 15, and middle shafts 12, 17, along with the U-shaped connectors 11, 16, define the cushion receiving region in which a seat cushion may be received. In some embodiments, these support arms may be pivotally attached to the base sheet, such that the device may be folded into a more compact shape.

Figure 3:
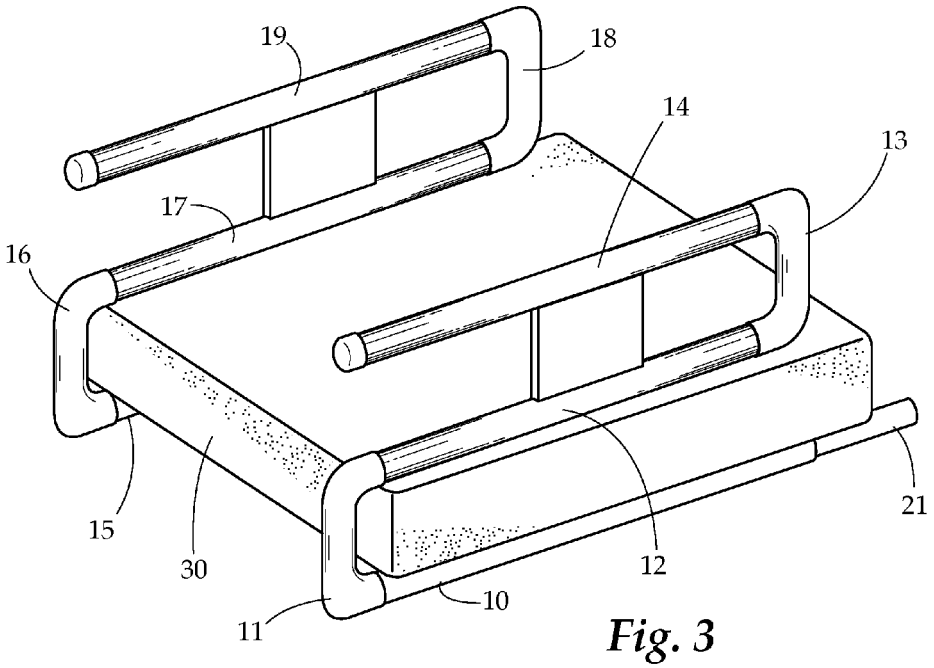
FIG. 3 provides a perspective view of another embodiment of the present invention.

FIG. 3 provides a perspective view of the seat support with a cushion positioned within the cushion receiving region. In this embodiment, the bottom shafts, 10, 15, middle shafts 12, 17, and top shafts 14, 19 are connected in an S-shape by U connectors 11, 13, 16, 18. The lower and middle shafts, 10, 15, 12, 17, along with the base sheet (not shown) define the cushion receiving region in which the cushion 30 is positioned. When compared with FIG. 2, it can be seen that the base sheet 20 has a cross sectional area that is greater than 50% of a cross sectional area of the cushion 30 positioned within the cushion receiving region.

Figure 4:
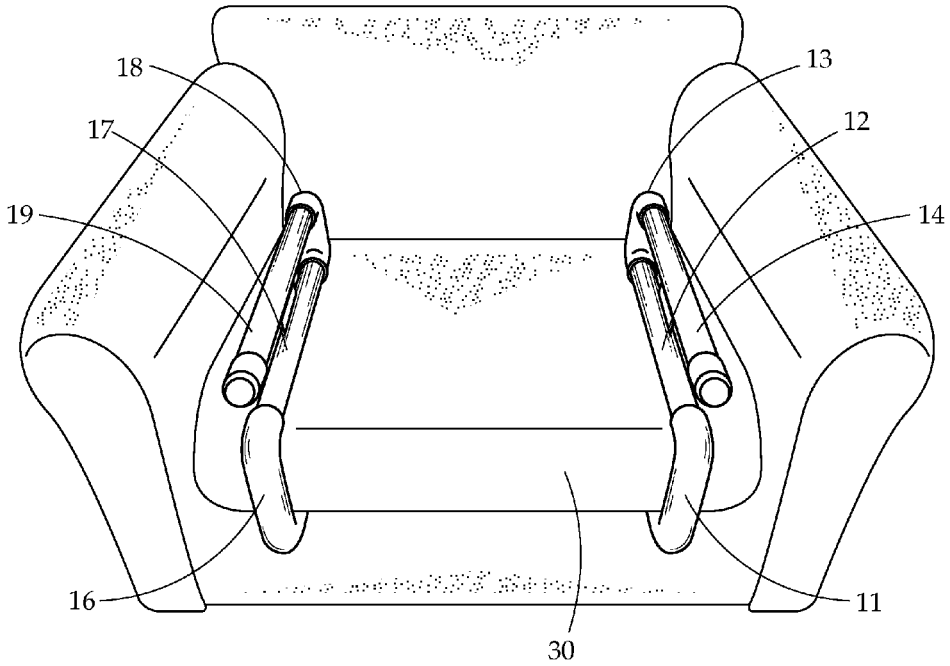
FIG. 4 provides a perspective view of an embodiment of the present invention in use.

FIG. 4 provides a view of the seat support in use. In this embodiment, a cushion is positioned within the cushion receiving region of the seat support. The cushion-seat support combination are positioned on a chair—thereby providing a cushion support as well as handles to aid in rising from a seated to standing position. In this embodiment, the bottom shafts, (not shown), middle shafts 12, 17, and top shafts 14, 19 are connected in an S-shape by U connectors 11, 13, 16, 18. The lower and middle shafts, 12, 17, along with the base sheet (not shown) define the cushion receiving region in which the cushion 30 is positioned. The cushion-seat support combination are together placed into the chair, making the chair now ready for a user who may need assistance moving from a seated to standing position.

Figure 5:
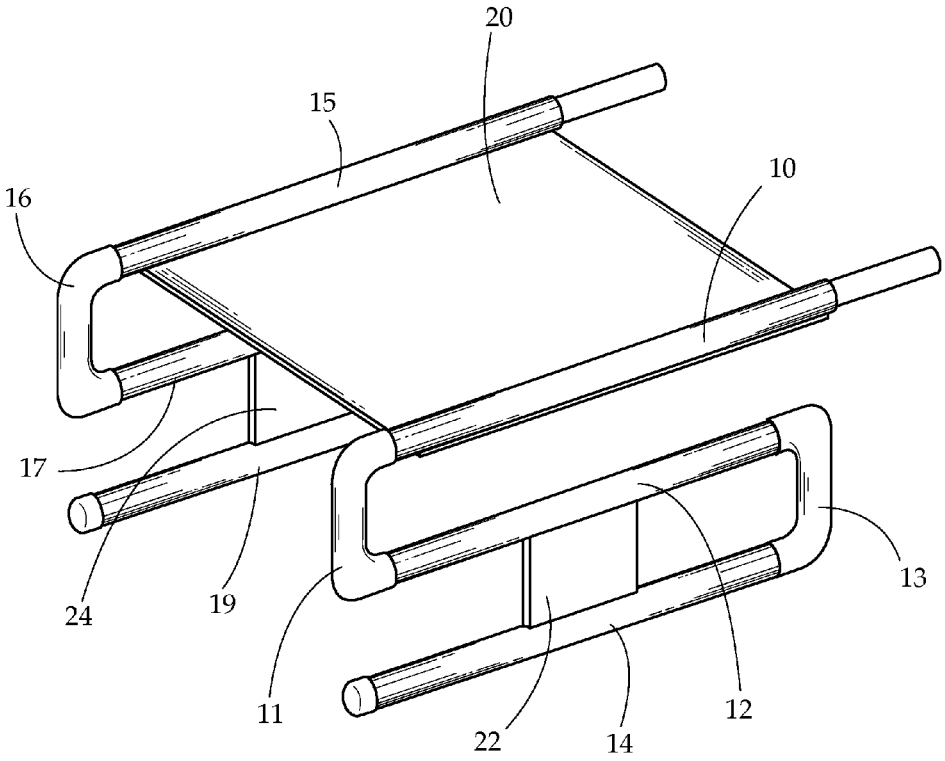
FIG. 5 provides a bottom perspective view of an embodiment of the present invention.

FIG. 5 shows another embodiment of a bottom perspective view of the device. In this embodiment, the connection of the base sheet 20 to the bottom shafts 10, 15 can be seen. However, it should be understood that the base sheet 20 may attach to the bottom shafts 10, 15 in any manner, including a rigid connection, hinged connection, or integrated together in a unitary construction. Further, it should be understood that while the base sheet 20 is shown as a solid sheet, in other embodiments the base sheet may have perforations in its surface.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A seat support comprising:

a substantially rigid base sheet;

two arm supports, each arm support attached to an opposite lateral side of the base sheet and defining a generally forward and rearward extending plane, each arm support having a portion extending along a bottom of the substantially rigid base sheet, and extending vertically away from the base sheet, each arm support comprising an S-shaped device, a lower portion of the S-shaped device opening rearwardly in a respective one of the planes and at least in part defining a cushion receiving region, and an upper portion of the S-shaped device opening forwardly and defining a support handle;

wherein each of the two arm supports comprise adjustable portions to adjust at least one of a length and a height of the arm support;

wherein the substantially rigid base sheet further defines a bottom of the cushion receiving region;

the substantially rigid base sheet having a cross sectional footprint area greater than 50% of a cross sectional area of a seat cushion placed within the cushion receiving region, and covering a center point of an area of the cushion receiving region, the arm support portion extending along the bottom of the base sheet and the base sheet formed to elevate the cushion above a surface on which the seat support rests; and the cushion receiving region being defined by the base sheet and at least the lower portion of each arm engaging a top sitting surface of the seat cushion.

2. The seat support of claim 1 wherein each of the two S-shaped arm support adjustable portions are formed as telescoping tubes.

3. The seat support of claim 1 further comprising a reinforcing connection on each of the S-shaped arm supports, the reinforcing connection connecting the support handle to the lower portion of the S shape.

4. The seat support of claim 1 wherein each of the two arm supports are rotatably attached to the base sheet.

5. The seat support of claim 4 wherein each of the two arm supports are rotatable inwards toward the base sheet, and wherein the seat support is capable of a storage position having the two arm supports folded inward against the base sheet.

6. A seat support comprising:

a substantially rigid base sheet;

two arm supports, each arm support attached to an opposite lateral side of the base sheet and defining a generally forward and rearward extending plane and extends vertically away from the base sheet, each arm support and the base sheet defining a cushion receiving region, and an upper portion of the S-shaped device opening forwardly and defining a support handle, each arm support comprising an S-shaped device, a lower portion of the S-shaped device opening rearwardly in a respective one of the planes and at least in part having a portion extending along a bottom of the substantially rigid base sheet;

the cushion receiving region being defined by the base sheet and at least the lower portion of each arm engaging a top sitting surface of the seat cushion;

wherein each of the two arm supports comprise adjustable portions to adjust at least one of a length and a height of the arm support; and a seat cushion positioned within the cushion receiving region, the seat cushion resting directly on the base sheet, the base sheet having a height, the base sheet height, and the portion of each arm extending along the bottom of the substantially rigid base sheet elevating the cushion placed within the cushion receiving region, the base sheet being sized and configured to support the cushion within the cushion receiving region such that the rigidity of the base sheet limits a sagging at a center of the cushion.

7. The seat support of claim 6 wherein each of the two S-shaped arm support adjustable portions are formed as telescoping tubes.

8. The seat support of claim 6 further comprising a reinforcing connection on each of the S-shaped arm supports, the reinforcing connection connecting the support handle to the lower portion of the S shape.

9. The seat support of claim 6 wherein the base sheet has a cross sectional footprint area greater than 50% of a cross sectional area of the cushion.

10. The seat support of claim 6 wherein each of the two arm supports are attached to the base sheet on a bottom of the base sheet.

11. A seat comprising:

a seating area, the seating area having a back, and a bottom, the bottom having a cushion;

a seat support, the seat support comprising:

a substantially rigid base sheet;

two arm supports, each arm support attached to an opposite lateral side of the base sheet and defining a generally forward and rearward extending plane and extending vertically away from the base sheet, each arm support and the base sheet defining a cushion receiving region, and an upper portion of the S-shaped device opening forwardly and defining a support handle, each arm support comprising an S-shaped device, a lower portion of the S-shaped device opening rearwardly in a respective one of the planes and at least in part having a portion extending along a bottom of the substantially rigid base sheet;

the cushion receiving region being defined by the base sheet and at least the lower portion of each arm engaging a top sitting surface of the seat cushion;

wherein each of the two arm supports comprise adjustable portions to adjust at least one of a length and a height of the arm support; and the seat support being positioned on the seat such that the cushion is within the cushion receiving region of each arm support and on top of the base sheet, and positioned such that with the substantially rigid base sheet being beneath the cushion, the base sheet having a height, the base sheet height, and the portion of each arm extending along the bottom of the substantially rigid base sheet elevating the cushion placed within the cushion receiving region, the base sheet being sized and configured to support the cushion within the cushion receiving region such that the rigidity of the base sheet limits a sagging at a center of the cushion.

12. The seat support of claim 11 further comprising a reinforcing connection on each of the S-shaped arm supports, the reinforcing connection connecting the support handle to the lower portion of the S shape.

13. The seat support of claim 11 wherein each of the two arm supports are rotatably attached to the base sheet.

* * * * *